US008699738B2

(12) United States Patent
Saiki

(10) Patent No.: US 8,699,738 B2
(45) Date of Patent: Apr. 15, 2014

(54) SPEAKER SYSTEM WITH RESONANCE FREQUENCY APPROXIMATELY IDENTICAL TO THE PEAK FREQUENCY OF THE SOUND PRESSURE

(75) Inventor: Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 11 days.

(21) Appl. No.: 13/575,966

(22) PCT Filed: Nov. 2, 2011

(86) PCT No.: PCT/JP2011/006151

§ 371 (c)(1),
(2), (4) Date: Jul. 30, 2012

(87) PCT Pub. No.: WO2012/073431

PCT Pub. Date: Jun. 7, 2012

(65) Prior Publication Data

US 2012/0300967 A1 Nov. 29, 2012

(30) Foreign Application Priority Data

Dec. 3, 2010 (JP) ..... 2010-270765
Apr. 15, 2011 (JP) ..... 2011-091183

(51) Int. Cl.
*H04R 1/20* (2006.01)

(52) U.S. Cl.
USPC ..... 381/349

(58) Field of Classification Search
USPC ..... 381/349
See application file for complete search history.

(56) References Cited

U.S. PATENT DOCUMENTS 5,432,860 A * 7/1995 Kasajima et al. ..... 381/349
6,324,292 B1 11/2001 Mitsuhashi et al.

FOREIGN PATENT DOCUMENTS

| | | |
|---|---|---|
| EP | 0 456 416 | 11/1991 |
| JP | 4-017497 | 1/1992 |
| JP | 4-081099 | 3/1992 |
| JP | 4-110087 | 9/1992 |
| JP | 9-009384 | 1/1997 |
| JP | 2000-125387 | 4/2000 |
| JP | 2008-211388 | 9/2008 |
| JP | 2008-211389 | 9/2008 |
| JP | 2009-055605 | 3/2009 |
| JP | 2010-258942 | 11/2010 |
| WO | 2008/102516 | 8/2008 |

OTHER PUBLICATIONS

International Search Report issued Dec. 13, 2011 in International (PCT) Application No. PCT/JP2011/006151.

* cited by examiner

*Primary Examiner* — Brian Ensey
*Assistant Examiner* — Katherine Faley
(74) *Attorney, Agent, or Firm* — Wenderoth, Lind & Ponack, L.L.P.

(57) ABSTRACT

A speaker system includes: a speaker cabinet; a speaker unit installed in a wall surface of said speaker cabinet; and an acoustic tube having ends, one of which is open and the other of which is closed, in which said acoustic tube is provided in said speaker cabinet such that a side wall surface of said acoustic tube crosses a direction in which standing waves propagates, the waves occurring inside said speaker cabinet.

9 Claims, 14 Drawing Sheets

FIG. 13 - PRIOR ART
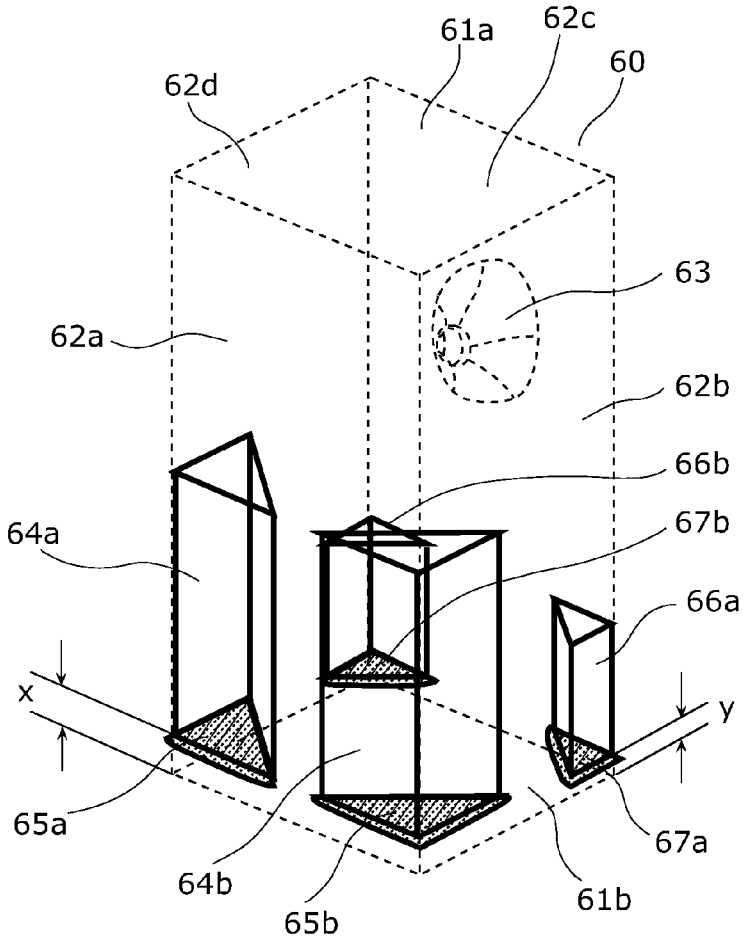

FIG. 14 - PRIOR ART
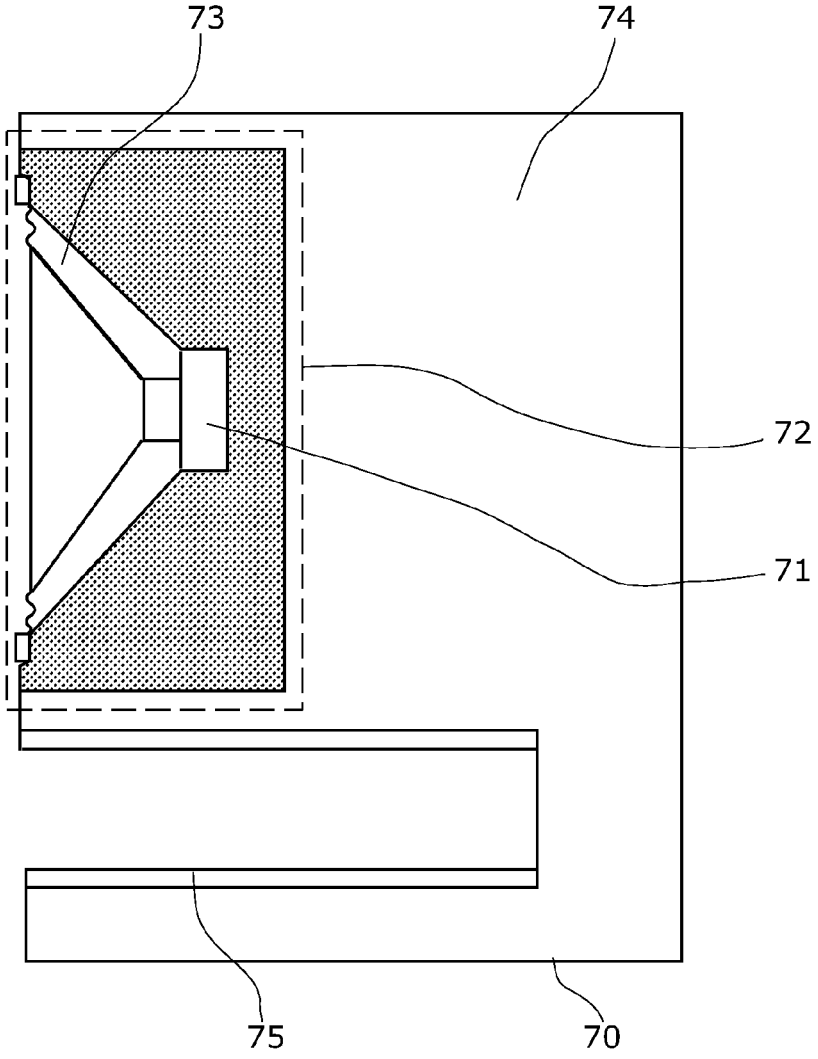

SPEAKER SYSTEM WITH RESONANCE FREQUENCY APPROXIMATELY IDENTICAL TO THE PEAK FREQUENCY OF THE SOUND PRESSURE

TECHNICAL FIELD

The present invention relates to suppression of disturbances in sound pressure frequency characteristics due to the cabinet shape of a speaker system.

BACKGROUND ART

In recent years, with reduction in the thickness of crystal liquid displays and practical application of organic EL, television sets have become thinner. At the same time, speaker systems for television sets have also become thinner. However, in a low-profile speaker system, the propagation direction of sound within a speaker cabinet is limited by its thinness, and effects of standing waves that occur between the opposing walls in the cabinet are larger than a conventional cuboid cabinet. This causes large peaks and troughs in sound pressure frequency characteristics of a speaker, system.

The speaker system disclosed in Patent Literature 1 is a related art to solve this problem. FIG. 13 is a cross-sectional view of the conventional speaker system disclosed in Patent Literature 1. The speaker system illustrated in FIG. 13 includes a cuboid speaker cabinet 60, a speaker unit 63, first acoustic tubes 64*a* and 64*b*, and second acoustic tubes 66*a* and 66*b*.

The speaker cabinet 60 includes a top board 61*a*, a bottom board 61*b*, and side boards 62*a*, 62*b*, 62*c*, and 62*d*. Sound absorbing materials 65*a* and 65*b* are provided at the openings of the first acoustic tubs 64*a* and 64*b*, respectively. Sound absorbing materials 67*a* and 67*b* are provided at the openings of the second acoustic tubs 66*a* and 66*b*, respectively.

The operations of a conventional speaker system configured as above will be described. When an electrical signal is inputted into the speaker unit 63 attached to the side board 62*b* of the speaker cabinet 60, sound is also emitted into the speaker cabinet 60. At this time, standing waves occur between the top board 61*a* and the bottom board 61*b* opposed to each other in the longer direction of the speaker cabinet 60. The standing waves occur at a frequency $f_1$ having a wavelength that is equal to a half of the distance between the top board 61*a* and the bottom board 61*b*.

Here, the first acoustic tubes 64*a* and 64*b* are provided at the corner parts between the side boards 62*a* and 62*d*, and between the side boards 62*a* and 62*b* of the speaker cabinet 60, respectively. The first acoustic tubes 64*a* and 64*b* with end parts closed are perpendicular to the bottom board 61*b*, maintain a gap X from the bottom board 61*b*, and have the absorbing materials 65*a* and 65*b* at each opening. In addition, each length of the first acoustic tubes 64*a* and 64*b* is equal to one-fourth of the wavelength of standing waves which occur at the frequency $f_1$. The first acoustic tubes 64*a* and 64*b* absorb and suppress the standing waves at the frequency $f_1$.

Likewise, standing waves occur at a frequency $f_2$ (twice the frequency $f_1$) having a wavelength that is equal to the distance between the top board 61*a* and the bottom board 61*b*. Standing waves at the frequency $f_2$ are suppressed by the second acoustic tubes 66*a* and 66*b* which are provided at the corner parts between the side boards 62*c* and 62*b*, and between the side boards 62*c* and 62*d* of the speaker cabinet 60 respectively, in the same configuration as the acoustic tubes 64*a* and 64*b* in the speaker cabinet. In this case, each length of the second acoustic tubes 66*a* and 66*b* is half length of the first acoustic tubes 64*a* and 64*b* (i.e., one eighth of the wavelength of standing waves at the frequency $f_1$).

As a result, the first acoustic tubes 64*a* and 64*b* suppress standing waves having a frequency 2n−1 times the frequency $f_1$. Here, n=1, 2, 3 . . . . In addition, the second acoustic tubes 66*a* and 66*b* suppress standing waves having a frequency 2(2n−1) times the frequency $f_1$. This reduces disturbance in sound pressure frequency characteristics due to the standing waves of the speaker cabinet 60.

CITATION LIST

Patent Literature

[PTL 1] Japanese Unexamined Patent Application Publication No. 2000-125387

[PTL 2] Japanese Unexamined Patent Application Publication No. 2009-55605

SUMMARY OF INVENTION

Technical Problem

However, in the speaker system disclosed in Patent Literature 1, the speaker cabinet 60 is required to have the first and second acoustic tubes 64*a*, 64*b*, 66*a*, and 66*b* of different lengths in order to suppress standing waves at the different frequencies $f_1$ and $f_2$. Furthermore, in terms of the narrow internal space of the speaker cabinet 60, it is also difficult to provide the first and second acoustic tubes 64*a*, 64*b*, 66*a*, and 66*b* of two different lengths within the low-profile speaker cabinet 60.

In addition, a bass reproduction limit frequency depends on the internal capacity of the speaker cabinet 60. In other words, it is advantageous to have a larger capacity of the speaker cabinet 60. In this case, the internal capacities of the first and second acoustic tubes 64*a*, 64*b*, 66*a*, and 66*b* are also considered as a part of the capacity of the speaker cabinet 60. However, since the first and second acoustic tubes 64*a*, 64*b*, 66*a*, and 66*b* have the absorbing materials 65*a*, 65*b*, 67*a*, and 67*b* respectively at each opening, a part of sound in the bass range passes through the absorbing materials 65*a*, 65*b*, 67*a*, and 67*b*. Therefore, damping effect by the absorbing materials 65*a*, 65*b*, 67*a*, and 67*b* is apparent in the bass range and this leads to a problem that sound pressure level is lowered in the bass range.

The present invention has been made in view of the above problems. Accordingly, an object of the present invention is to provide a speaker system that can suppress occurrence of standing waves without lowering sound pressure level in the bass range.

Solution to Problem

A speaker system in accordance with an embodiment of the present invention includes a speaker cabinet; a speaker unit which is installed in a wall surface of the speaker cabinet and outputs sound; and an acoustic tube having ends, one of which is open and the other of which is closed. The acoustic tube is provided inside the speaker cabinet such that a side wall surface of the acoustic tube crosses a direction in which standing waves propagates, the waves occurring inside the speaker cabinet.

The above placement of the acoustic tube can suppress standing waves at multiple frequencies which are caused by the relationship between the distance between the opposing walls within the speaker cabinet and a wavelength of sound emitted into the speaker cabinet. Moreover, in the bass range having lower frequencies than those at which standing waves occur, the capacity of the acoustic tube serves as a part of the capacity of the speaker cabinet and thus sound pressure level in the bass range is not lowered.

As an example, the speaker cabinet may be a pillar-shaped speaker cabinet that is greater in height than in width or depth. The acoustic tube may be provided inside the speaker cabinet so as to reduce an apparent height of an inside of the speaker cabinet.

As another example, the speaker cabinet may be a thin cuboid that is smaller in thickness than in length or breadth. The acoustic tube may be provided inside the speaker cabinet so as to reduce an apparent length in a longer direction of an inside of the speaker cabinet.

Moreover, the speaker cabinet may have a bass reflex port.

Moreover, a resonance frequency that is determined by an inductance component of an acoustic impedance of the acoustic tube and an acoustic compliance of the speaker cabinet may substantially be identical to a peak frequency of a sound pressure of the speaker unit which is installed in the speaker cabinet.

According to the above configuration, the resonance between the acoustic tube provided in the speaker cabinet and the internal space of the speaker cabinet can suppress the sound pressure peak of a resonance frequency $f_o$ of the speaker unit which is attached to the speaker cabinet. As a result, flat sound pressure frequency characteristics with fewer peaks and troughs can be obtained.

Moreover, the speaker system may be a bass reflex speaker system. The resonance frequency may substantially be identical to the peak frequency which is higher than a lowest resonance frequency of the speaker unit which is not installed in the speaker cabinet.

Moreover, the larger a band width of a sound pressure peak of the speaker unit is, the larger an ratio of an internal space capacity of the acoustic tube to an internal space capacity of the speaker cabinet may be.

Moreover, the acoustic tube may be formed of an inner wall surface of the speaker cabinet and partition boards that are connected to the inner wall surface.

Moreover, a sound absorbing material is provided at the closed end of said acoustic tube.

Advantageous Effects of Invention

A speaker system according to the present invention can suppress standing waves at multiple frequencies which are caused by the relationship between the distance between the opposing walls inside the speaker cabinet and a wavelength of sound emitted into the speaker cabinet. Moreover, in the bass range having lower frequencies than those at which standing waves occur, the capacity of the acoustic tube serves as a part of the capacity of the speaker cabinet and thus sound pressure level in the bass range is not lowered. As a result, a speaker system with high sound quality which has small disturbances in the reproduction sound pressure due to the standing waves can be made without lowering the sound pressure level in the bass range.

BRIEF DESCRIPTION OF DRAWINGS

FIG. 13 is a cross-sectional view of a conventional speaker system.

FIG. 14 is a cross-sectional view of a conventional speaker system.

DESCRIPTION OF EMBODIMENTS

Hereinafter, embodiments of the present invention will be described with reference to the drawings.

First Embodiment

Figure 1A:
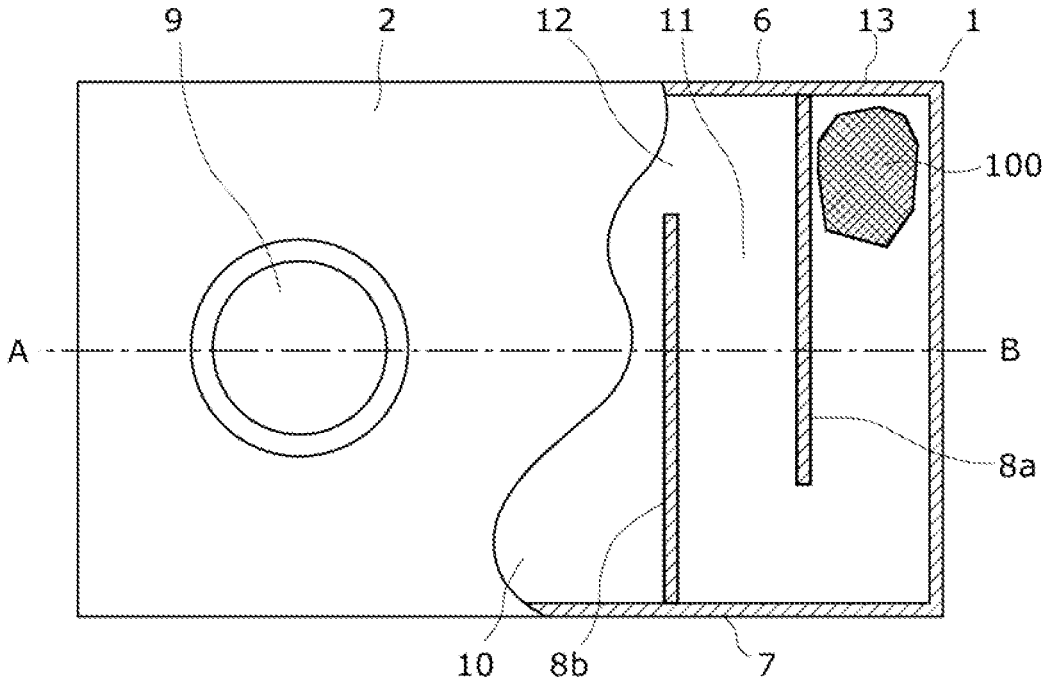
FIG. 1A is a plan view of a speaker system in accordance with the first embodiment.
Figure 1B:
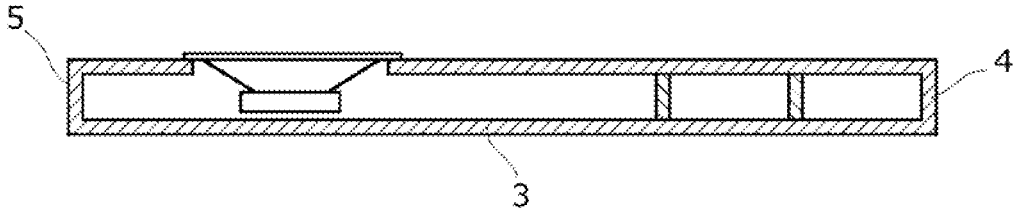
FIG. 1B is a cross-sectional view of a speaker system in accordance with the first embodiment.

FIGS. 1A and 1B show a speaker system in accordance with the first embodiment of the present invention. FIG. 1A is a plan view, partially cut-away, of the surface of the speaker system in accordance with the first embodiment. FIG. 1B is a cross-sectional view taken along the line A-B in FIG. 1A. The speaker system shown in FIGS. 1A and 1B includes a cuboid and low-profile speaker cabinet 1, partition boards 8*a* and 8*b* provided within the speaker cabinet 1, and a speaker unit 9.

The speaker cabinet 1 includes a front board 2, a back board 3, side boards 4 and 5 in the longitudinal direction, and side boards 6 and 7 in the lateral direction. The speaker unit 9 is attached to the front board 2 of the speaker cabinet 1. The partition board 8*a* is connected with the front board 2, the back board 3, and the side board 6 in the lateral direction of the speaker cabinet 1. On the other hand, the partition board 8*b* is connected with the front board 2, the back board 3, and the side board 7 in the lateral direction of the speaker cabinet 1. Furthermore, an acoustic tube 11 within the speaker cabinet 1 is formed of the partition boards 8*a* and 8*b*, the front board 2, the back board 3, and the side boards 6 and 7. The acoustic tube 11 has one end (opening 12) open and the other end (end part 13) closed.

With reference to the sound pressure frequency characteristics in FIG. 2, the operations of a speaker system configured as above will be described. When an electrical input is applied to the speaker unit 9 attached to the front board 2 of the speaker cabinet 1, a diaphragm vibrates to emit sound. At the time, the sound emitted into the internal space of the speaker cabinet 1 is transmitted to the inside of the acoustic tube 11 which is formed of the partition boards 8*a* and 8*b*. Here, since the end part 13 of the acoustic tube 11 is closed, the sound in the speaker cabinet 1 is not emitted from the acoustic tube 11 into the outside of the speaker cabinet 1.

Thus, the major difference between a conventional speaker system and a speaker system in accordance with the first embodiment is that the acoustic tube 11 is provided inside the speaker cabinet 1. Therefore, the operations of the speaker system in accordance with the first embodiment will be described in comparison with a conventional closed-type and thin-profile speaker system.

Here, the measurements of the inside of the speaker cabinet 1 in accordance with the first embodiment illustrated in FIGS. 1A and 1B are 410 mm long, 210 mm wide and 10 mm thick. In addition, the electrodynamic speaker unit 9 has an aperture of 8 cm and a thickness of 12 mm. Furthermore, the partition boards 8*a* and 8*b* are both 180 mm long and the distance between each other is 30 mm.

In other words, the speaker cabinet 1 in accordance with the first embodiment is a cuboid that has a thin thickness measurement compared to length and width measurements. In other words, the ratio of the thickness measurement to the measurement of the longer direction (longitudinal direction) is 410/10=41. It is more preferable that the acoustic cabinet 11 be provided in the speaker cabinet 1 with the ratio of 10 or more, or more preferably 20 or more as follows.

The acoustic tube 11 in accordance with the first embodiment is provided so as to reduce the apparent length in the longer direction (longitudinal direction in this example) of the inside of the speaker cabinet 1. In other words, the acoustic tube 11 is provided such that the side wall surface of the acoustic tube 11 (partition board 8*b*) and the propagation direction of standing waves which occur inside the speaker cabinet 1 (longer direction) cross each other or intersect at right angles.

Figure 2:
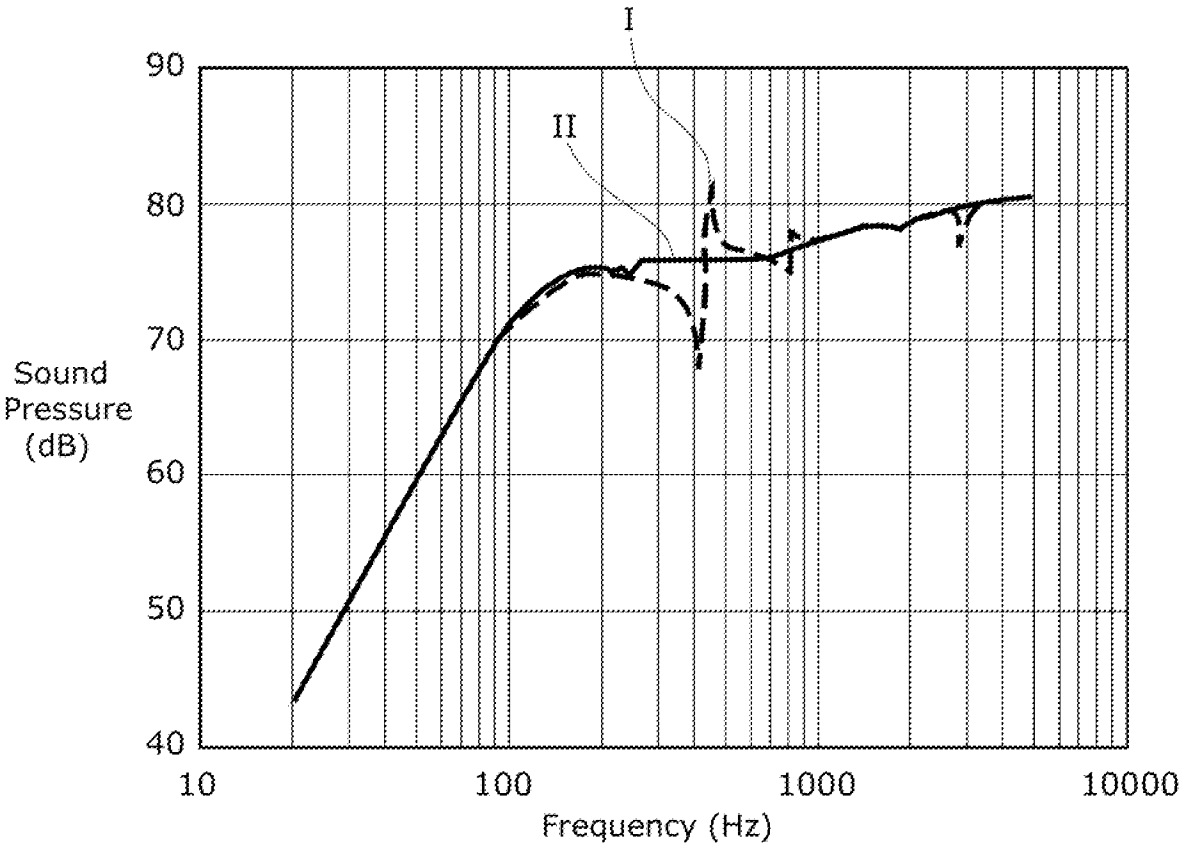
FIG. 2 shows sound pressure frequency characteristics of a speaker system in accordance with the first embodiment.

In the speaker system shown in FIGS. 1A and 1B, the characteristic I in FIG. 2 indicates the sound pressure frequency characteristic of a conventional closed-type speaker system in the absence of the acoustic tube 11. In this case, standing waves occur between the side boards 4 and 5 opposed to each other in the longer direction of the speaker cabinet 1. This leads to a peak and a trough in sound pressure at around 400 Hz, i.e., a large disturbance to the sound pressure frequency characteristics.

Next, the operations of the speaker system when the acoustic tube 11 in accordance with the first embodiment is provided within the speaker cabinet 1 will be described. The acoustic tube 11 with one end open and the other end closed is formed of the partition boards 8*a* and 8*b*. The partition boards 8*a* and 8*b* are provided almost parallel with the side board 4 which is one side in the longer direction of the speaker cabinet 1. In other words, the partition boards 8*a* and 8*b* are almost perpendicular to the direction of the mode of the standing waves which occur between the side boards 4 and 5 in the longer direction when the acoustic tube 11 is not provided.

As a result, the inside of the speaker cabinet 1 can be acoustically divided into the space where the acoustic tube 11 is provided and a back capacity 10 of the speaker unit 9. Note that the back capacity 10 of the speaker unit 9 means the capacity of the space which excludes the space enclosed by the partition boards 8*a* and 8*b* (i.e., acoustic tube 11) from the internal space of the speaker cabinet 1.

Thus, the sound from the speaker unit 9 is emitted into the back capacity 10 and then transmitted to the acoustic tube 11. Here, since the partition boards 8*a* and 8*b* have a narrow distance of 30 mm therebetween, it is acoustically considered that the long and narrow acoustic tube 11 is attached to the back capacity 10. More specifically, the acoustic tube 11 in accordance with the first embodiment is a sound path that is turned around by the partition boards 8*a* and 8*b* and the length is approximately 400 mm. The acoustic tube 11 is rectangular in cross section and when the tube viewed from cross section is considered as a circle, the diameter is approximately 20 mm.

Thus, both the back capacity 10 and the acoustic tube 11 are located between the side boards 4 and 5 opposed to each other in the longer direction of the speaker cabinet 1. The characteristic II in FIG. 2 is a sound pressure frequency characteristic of the speaker system in accordance with the first embodiment. As is evident from the characteristic II, it is possible to remove the standing waves which occur at around 400 Hz when the acoustic tube 11, as indicated by the characteristic I is not provided. On the other hand, although a resonance that occurs due to the newly provided acoustic tube 11 causes a small trough in sound pressure at around 250 Hz, this does not cause a large disturbance to the sound pressure frequency characteristics of the speaker system.

Furthermore, a peak and a trough in sound pressure at around 800 Hz which is twice 400 Hz can be found from a detailed analysis of the sound pressure frequency characteristics shown in FIG. 2. The frequency is due to the standing waves equivalent to the frequency $f_2$ which is twice the frequency $f_1$ of 400 Hz recited in the reference 1. The characteristic II of the first embodiment shows a flat characteristic without a peak and a trough at around 800 Hz. In other words, it is clear that the acoustic tube 11 suppresses the standing waves not only at the frequency $f_1$, but also at the frequency $f_2$.

Thus, according to the first embodiment, a speaker system with high sound quality can be made, which has very small disturbances in the sound pressure frequency characteristics due to the multiple standing waves which occur in the speaker cabinet 1. Furthermore, unlike the reference 1, a sound absorbing material is not provided at the opening 12 of the acoustic tube 11. Therefore, the sound in the speaker cabinet 1 is not damped by the sound absorbing material, thus preventing the decline in sound pressure level, especially in the bass range.

Note that as shown in FIGS. 1A and 1B, the sound absorbing material 100 may additionally be placed on the end part 13 of the acoustic tube 11. Accordingly, when there is a large resonance at around 250 Hz due to the acoustic tube 11, the placement of the sound absorbing material 100 can more effectively suppress the resonance and lead to flat sound pressure frequency characteristics (For the sound pressure frequency characteristic indicated by the characteristic II in FIG. 2, the sound absorbing material 100 is not placed.) In this case, the sound absorbing material 100 is provided within the speaker cabinet 1. However, since the sound absorbing material 100 is placed on the end part 13 which is the closed end of the acoustic tube 11, only a small amount of sound passes through the end part 13. Thus, there is only a slight decline in sound pressure level in the bass range due to the absorbing effects of the absorbing material 100.

Note that although the acoustic tube 11 is provided near the side board 4 in the longitudinal direction, another acoustic tube may also be provided nearby the side board 5 which is opposed to the side board 4. In this case, since both of the surfaces opposed to each other in the longitudinal direction have the acoustic tubes 11, occurrence of standing waves is suppressed more effectively than when the acoustic tube 11 is provided on only one side.

Note that although the acoustic tube 11 is provided in the cuboid speaker cabinet 1 which has a thin thickness measurement compared to length and width measurements in the above example, placement of the acoustic tube 11 is not limited to a speaker cabinet of this shape. For example, an acoustic tube may be provided within a pillar-shaped speaker cabinet that has a tall height compared to width and depth measurements (the following embodiments are the same). In this case, the acoustic tube may be provided near the top or bottom board inside the speaker cabinet so as to reduce the apparent height of the inside of the speaker cabinet.

Second Embodiment

Figure 3A:
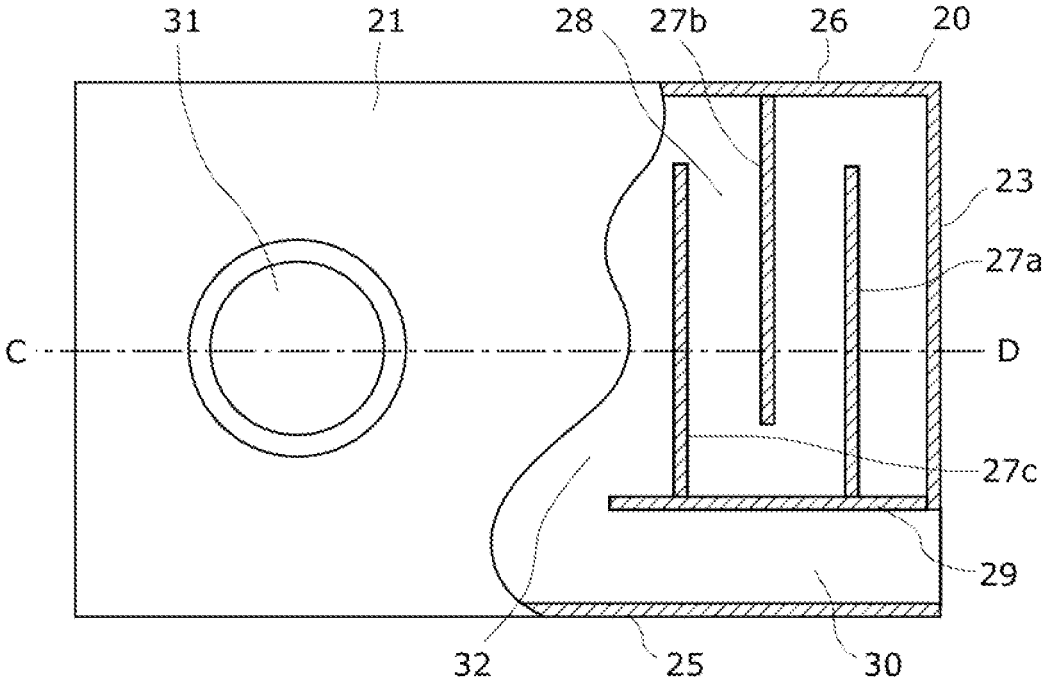
FIG. 3A is a plan view of a speaker system in accordance with the second embodiment.
Figure 3B:
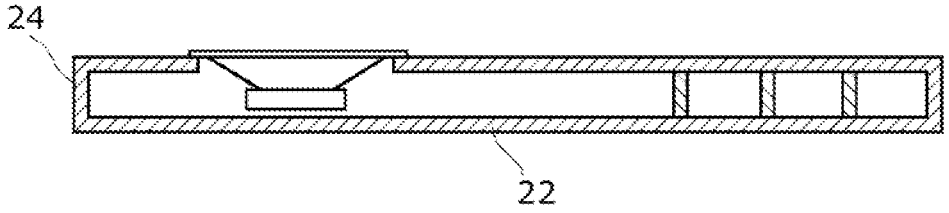
FIG. 3B is a cross-sectional view of a speaker system in accordance with the second embodiment.

Next, FIGS. 3A and 3B show a speaker system in accordance with the second embodiment of the present invention. FIG. 3A is a plan view, partially cut-away, of the surface of the speaker system in accordance with the second embodiment. FIG. 3B is a cross-sectional view taken along the line C-D in FIG. 3A. The speaker system shown in FIGS. 3A and 3B includes a cuboid and low-profile speaker cabinet 20, partition boards 27*a*, 27*b*, 27*c*, and 29, an acoustic tube 28, an acoustic port 30, and a speaker unit 31 attached to a front board 21.

The speaker cabinet 20 includes a front board 21, a back board 22, side boards 23 and 24 in the longitudinal direction, and side boards 25 and 26 in the lateral direction. The partition board 29 is provided in parallel with the side board 25. Furthermore, the acoustic port (bass reflex port) 30 is formed of the front board 21, the back board 22, the side board 25, and the partition board 29. In addition, the acoustic tube 28 with one end open and the other end closed is formed of the partition boards 27*a*, 27*b*, 27*c*, and 29, the front board 21, the back board 22, and the side boards 23 and 26.

With reference to the sound pressure frequency characteristics in FIG. 4, the operations of a speaker system configured as above will be described. The difference from the first embodiment is that a type of speaker system is changed from the closed type to the bass reflex type.

When an electrical input is applied to the speaker unit 31 attached to the front board 21 of the speaker cabinet 20, a diaphragm vibrates to emit sound. At the time, the sound emitted into the internal space of the speaker cabinet 20 is transmitted to the inside of the acoustic tube 28 which is formed of the partition boards 27*a*, 27*b*, and 27*c*. Here, since the end part of the acoustic tube 28 is closed, the sound in the speaker cabinet 20 is not emitted from the acoustic tube 28 into the outside of the speaker cabinet.

Although the operations above are the same as the first embodiment, in the bass reflex speaker system in accordance with the second embodiment, the speaker cabinet 20 includes the acoustic port 30 by providing the partition board 29. In other words, sound pressure level in the bass range is higher than the first embodiment due to the acoustic resonance between the acoustic port 30 and the internal capacity of the speaker cabinet 20.

In order to explain the effects of the second embodiment, sound pressure frequency characteristics of a conventional bass reflex speaker system which eliminates the acoustic tube 28 from the speaker cabinet 20 in FIG. 3A and FIG. 3B will be compared with those of a speaker system in accordance with the second embodiment. Thus, the major difference between the conventional speaker system and the speaker system in the second embodiment is that the acoustic tube 28 is provided inside the speaker cabinet 20. Therefore, the operations of the speaker system in accordance with the second embodiment will be described in comparison with a conventional bass reflex and thin-profile speaker system.

Here, the measurements of the inside of the speaker cabinet 20 in accordance with the second embodiment are 410 mm long, 210 mm wide and 10 mm thick as same as the first embodiment. In addition, the electrodynamic speaker unit 31 has an aperture of 8 cm and a thickness of 12 mm. Furthermore, each of the partition boards 27*a*, 27*b*, and 27*c* is 88 mm long and the distances between each other are 30 mm. Furthermore, the acoustic port 30 is 130 mm long.

In addition, the acoustic tube 28 is provided so as to reduce the apparent length in the longer direction (longitudinal direction in this example) of the inside of the speaker cabinet 28. In other words, the acoustic tube 28 is provided such that the side wall surface of the acoustic tube 28 (partition board 27*c*) and the propagation direction of standing waves which occur inside the speaker cabinet 20 (longer direction) cross each other or intersect at right angles.

Figure 4:
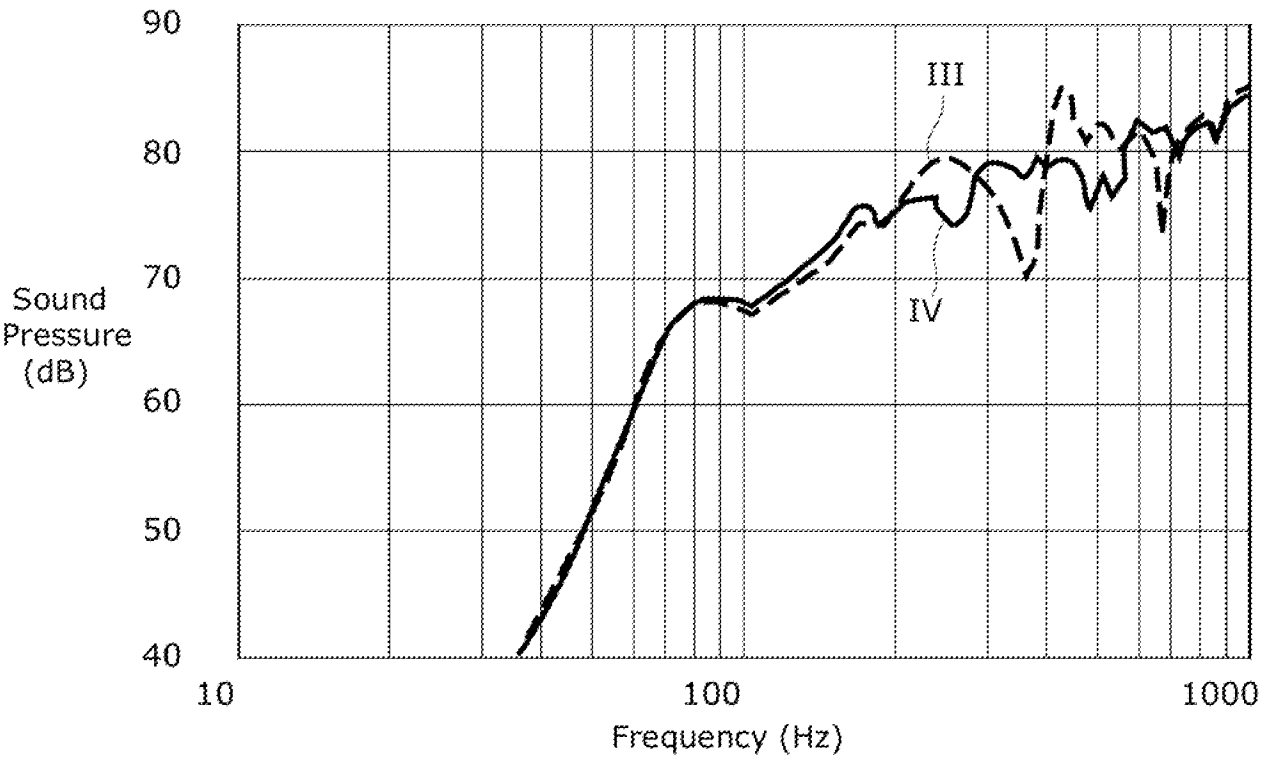
FIG. 4 shows sound pressure frequency characteristics of a speaker system in accordance with the second embodiment.

The characteristic III in FIG. 4 indicates a sound pressure frequency characteristic of the conventional bass reflex speaker system which does not include the acoustic tube 28 in the speaker system shown in FIGS. 3A and 3B. Since a resonance of the acoustic port 30 increases the sound pressure level at around 80 Hz in the characteristic III, it is clear that the effects of the bass reflex speaker system are obtained. On the other hand, standing waves occur between the side boards 23 and 24 opposed to each other in the longer direction of the speaker cabinet 20, leading to a peak and a trough in sound pressure at around 360 Hz. This causes a large disturbance to the sound pressure frequency characteristics.

Next, the operations of the speaker system in accordance with the second embodiment, which has the acoustic tube 28 inside the speaker cabinet 20, will be described. Each of the partition boards 27*a*, 27*b*, and 27*c* is provided almost parallel with the side board 23 which is one side in the longer direction of the speaker cabinet 20. In other words, the acoustic tube 28 with one end open and the other end closed are almost perpendicular to the direction of the mode of the standing waves which occur between the side boards 23 and 24 in the longer direction when the acoustic tube 28 is not provided.

As a result, the inside of the speaker cabinet 20 can be divided into the space where the acoustic tube 28 is provided, a back capacity 32 of the speaker unit 31, and the acoustic port 30. Note that the back capacity 32 of the speaker unit 31 means the capacity of the space which excludes the acoustic tube 28 and the acoustic port 30 from the internal space of the speaker cabinet 20. Thus, the sound from the speaker unit 31 is emitted into the back capacity 32 and then transmitted to the acoustic tube 28 and the acoustic port 30.

Here, the partition boards 27*a*, 27*b*, and 27*c* have a narrow distance of 30 mm therebetween as same as the first embodiment.

Therefore, it is acoustically considered that the acoustic tube 28 with the end part closed and the acoustic port 30 are attached to the back capacity 32. More specifically, the acoustic tube 28 is approximately 480 mm. When the cross-section area of the acoustic tube 28 is considered as a circle, the diameter is approximately 20 mm. Thus, both the back capacity 32 and the acoustic tube 28 are provided between the side boards 23 and 24 opposed to each other in the longer direction of the speaker cabinet 20.

The characteristic IV in FIG. 4 is a sound pressure frequency characteristic of the speaker system in accordance with the second embodiment. The standing waves which occur at around 360 Hz when the acoustic tube 28 is not provided, as indicated by the characteristic III in FIG. 4 can be suppressed. On the other hand, although there is a little resonance at around 270 Hz due to the newly-provided acoustic tube 28, this does not cause a large disturbance to the sound pressure frequency characteristics of the speaker system. In other words, the speaker cabinet 20 allows for a speaker system with high sound quality.

In addition, in the characteristic in the absence of the acoustic tube 28 as indicated by the characteristic III in FIG. 4, a trough in sound pressure occurs at the frequency $f_2$ of 700 Hz due to the second standing waves. The frequency $f_2$ is twice the frequency $f_1$ of 350 Hz of the first standing waves. However, as shown in the characteristic IV in accordance with the second embodiment, the sound pressure frequency characteristic at 700 Hz is flat. In other words, according to the second embodiment, multiple standing waves are suppressed by the acoustic tube 28 alone without the need of the first and second acoustic tubes 64*a*, 64*b*, 66*a*, and 66*b* of different lengths, which are provided in the reference 1 in accordance with the first and second standing waves.

Here, in order to improve sound pressure level in the bass range, the bass reflex speaker system uses an acoustic resonance of an acoustic compliance that is determined by the acoustic mass of the acoustic port 30 and the capacity of the speaker cabinet 20. For reproduction in the lower bass range, it is necessary to increase the acoustic compliance of the speaker cabinet 20, i.e., to increase the internal capacity of the speaker cabinet 20.

In the second embodiment, since the acoustic tube 28 is provided within the speaker cabinet 20, the acoustic capacity seems to be reduced. However, in the band which has lower frequencies than the band which has a longer wavelength than the equivalent length of the acoustic tube 28 (for example, a wavelength of 3.4 m at 100 Hz), the space of acoustic tube 28 can be considered a part of the capacity of the speaker cabinet 20.

Therefore, the Internal capacity of the speaker cabinet 20 is the total capacity of the back capacity 32 of the speaker unit 31 and the capacity of the acoustic tube 28. As a result, there is no difference from the capacity of the conventional bass reflex type speaker cabinet 20 in the absence of the acoustic tube 28, and thus there are few differences in the bass range characteristics which are determined by the acoustic compliance of the speaker cabinet 20 and the resonance of the acoustic port 30. Thus, it is possible to make a bass reflex speaker system that has fewer disturbances in sound pressure due to multiple standing waves which occur within the speaker cabinet 20 and that is able to reproduce rich bass sound.

In addition, since a sound absorbing material is not provided at the opening of the acoustic tube 28 in contrast to the reference 1, the sound in the speaker cabinet 20 is not damped by the sound absorbing material. Therefore, the sound pressure level does not decrease especially in the bass range.

Here, in order to provide a lower-profile speaker system, it is necessary to reduce the thickness of a speaker unit to be installed in the speaker system so as to fit a low-profile cabinet. The current mainstream speaker units are electrodynamic speaker units that obtain a driving force by gathering magnetic flux from a magnet around a voice coil.

However, with reduction in the thickness of an electrodynamic speaker unit, a magnet constituting its magnetic circuit is also made thinner, thus reducing magnetic energy of the magnet. This results in a smaller driving force to be generated in the voice coil and lower sound pressure level. In addition, for electrodynamic speaker units, the Q-value of the lowest resonance frequency is damped by electromagnetic damping resistance that is caused by a counter-electromotive force generated by vibration of the voice coil. Thus, the decrease in magnetic flux due to the reduction in the thickness of the magnet lowers the electromagnetic damping force and a large peak in sound pressure occurs in sound pressure frequency characteristics at around the lowest resonance frequency $f_{OB}$ of the speaker unit which is attached to a speaker cabinet. This degrades sound quality.

Furthermore, another type of low-profile speaker unit is a piezoelectric speaker unit. Unlike the electrodynamic speaker unit, the piezoelectric speaker unit does not have a magnetic circuit that gathers magnetic flux from a magnet, and bends a diaphragm by the expansion and contraction of a thin piezoelectric element in the form of a board to emit sound. This allows a significant reduction in the thickness compared to the electrodynamic speaker unit. However, for the piezoelectric speaker unit, it is difficult to suppress the Q value of a resonance of the diaphragm and thus a large peak in sound pressure occurs at around the lowest resonance frequency $f_{OB}$. This disturbs sound pressure frequency characteristics of the speaker system and degrades sound quality as in the case of the electrodynamic speaker system with reduced magnetic energy of a magnet.

The speaker system disclosed in Patent Literature 2 is the known art to solve this problem. FIG. 14 is a cross-sectional view of the conventional speaker system recited in Patent Literature 2. The speaker system illustrated in FIG. 14 is a bass reflex speaker system that includes a loudspeaker cabinet 70, an electrodynamic loudspeaker unit 71, an acoustic resistance member 72, and a bass reflex port 75.

The operations of a conventional speaker system configured as above will be described. The sound from the rear of the diaphragm of the speaker unit 71 is emitted into the capacity 74 of the space enclosed by the rear of the diaphragm of the speaker unit 71 and the acoustic resistance member 72 after passing through the acoustic resistance member 72 from the volume 73 of the space enclosed by the acoustic resistance member 72 and the speaker cabinet 70. At this time, the acoustic resistance member 72 damps the sound which passes through the acoustic resistance member 72, thus dampening the vibration of the diaphragm of the speaker unit. This damps the sound pressure of the speaker system which is emitted from the front of the speaker unit. This damping effect flattens peaks and troughs in the sound pressure frequency characteristics of the speaker system.

In addition, as mentioned above, the speaker system disclosed in Patent Literature 1 has the first and second acoustic tubes 64*a*, 64*b*, 66*a*, and 66*b*, each of which has an opening at one end in order to prevent the standing waves, which occur in the opposing faces of the wall of the speaker cabinet 60, from disrupting movements of the diaphragm of the speaker unit 63 and disturbing the sound pressure frequency characteristics. Furthermore, the sound absorbing materials 65*a*, 65*b*, 67*a*, and 67*b* which seal the openings separate the internal spaces of the first and second acoustic tubes 64*a*, 64*b*, 66*a*, and 66*b* from the internal space of the speaker cabinet 60, respectively. Furthermore, each of the first and second acoustic tubes 64*a*, 64*b*, 66*a*, and 66*b* has a tube length of approximately 1/(2n) times the wavelength corresponding to the lowest resonance mode of the sanding waves to be generated along an inner wall surface of the speaker cabinet 60, and the first and second acoustic tubes 64*a*, 64*b*, 66*a*, and 66*b* are provided such that the openings are located in the vicinity of nodal points of standing waves. Here, n is a natural logarithm of 2 or more. This suppresses the standing waves and flattens the sound pressure frequency characteristics of the speaker system.

However, the speaker system disclosed in Patent Literature 2 has a damping effect on the wide bass range from around the lowest resonance frequency $f_{OB}$ of the speaker unit 71 which is attached to the speaker cabinet 70 to around the resonance frequency $f_{OP}$ of the bass reflex port 75. In particular, the vicinity of the resonance frequency $f_{OP}$ for the bass reflex port 75 of the speaker cabinet 70 is an important frequency band to obtain the sense of bass sound of the speaker system. The problem is a shortage of the sense of bass sound when the damping effect of the acoustic resistance member 72 suppresses into the sound pressure level around the resonance frequency $f_{OP}$ which is a bass reproduction limit.

In addition, in the speaker system disclosed in Patent Literature 1, the acoustic resonance of the first and second acoustic tubes 64*a*, 64*b*, 66*a*, and 66*b* suppresses the standing waves which occur in the speaker cabinet 60 to allow the diaphragm of the speaker unit 63 to easily move, thus flattening the trough in sound pressure. Therefore, peaks of sound pressure cannot be suppressed by controlling the movement of the speaker unit 63 at around the lowest resonance frequency $f_{OB}$ of the speaker unit 63.

The third and fourth embodiments have been made in view of the above problems. Accordingly, objects of the third and fourth embodiments are to provide a speaker system which can flatten peaks of sound pressure of a speaker unit without lowering sound pressure level in the bass range.

Third Embodiment

Figure 5A:
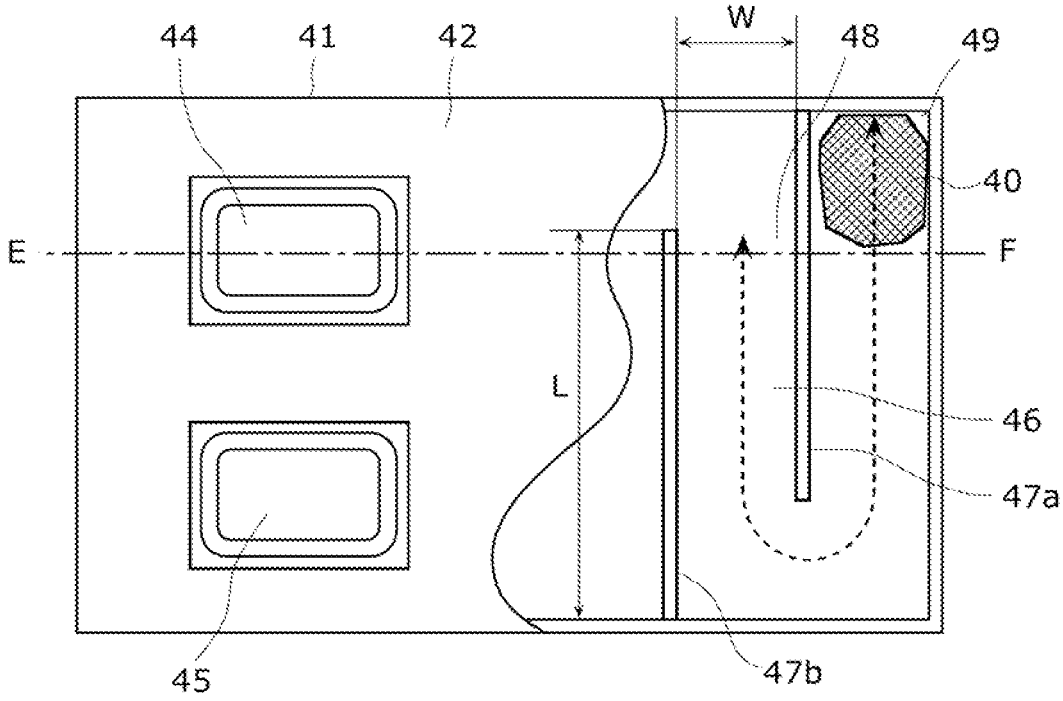
FIG. 5A is a plan view of a speaker system in accordance with the third embodiment.
Figure 5B:
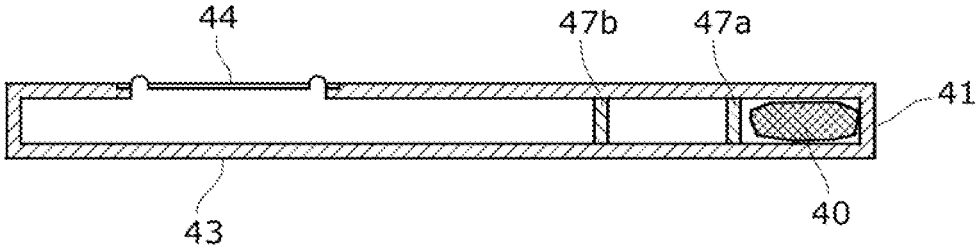
FIG. 5B is a cross-sectional view of a speaker system in accordance with the third embodiment.

FIGS. 5A and 5B show a speaker system in accordance with the third embodiment of the present invention. FIG. 5A is a plan view, partially cutaway, of the surface of a speaker system in accordance with the third embodiment. FIG. 5B is a cross-sectional view taken along the line E-F in FIG. 5A.

The speaker system shown in FIGS. 5A and 5B includes a speaker cabinet 41, a piezoelectric speaker unit 44, a drone cone 45, an acoustic tube 46, and a sound absorbing material 40. The speaker cabinet 41 includes a front board 42 and a back board 43. In addition, an acoustic tube 46 with one end (opening 48) open and the other end (end part 49) closed is formed of partition boards 47*a* and 47*b*. Furthermore, the sound absorbing material 40 is provided at the end part 49 of the acoustic tube 46.

Here, the speaker system described above is designed such that the resonance frequency which is determined by an inductance component of an acoustic impedance of the acoustic tube 46 and an acoustic compliance of the speaker cabinet 41 is substantially identical to a peak frequency of sound pressure of the speaker unit 44 which is attached to the speaker cabinet 41. The peak frequency at the time is higher than the lowest resonance frequency of the speaker unit 44 which is not attached to the speaker cabinet 41. In other words, the peak frequency should be nearly identical to the lowest resonance frequency $f_{OB}$ of the speaker unit 44 which is attached to the speaker cabinet 41.

Note that the inductance component of the acoustic impedance of the acoustic tube 46 changes according to the length of the acoustic tube 46 or the cross-sectional area of the acoustic tube 46. More specifically, the longer the length of the acoustic tube 46, the larger the inductance component. In addition, the acoustic compliance of the speaker cabinet 41 changes according to the capacity of the speaker cabinet 41. More specifically, the larger the capacity of the speaker cabinet 41, the larger the acoustic compliance.

For example, the resonance frequency $f_0$ can be obtained from the following equation 1. Here, M denotes the inductance component of the acoustic impedance of the acoustic tube 46 and C denotes the acoustic compliance of the speaker cabinet 41. In other words, the resonance frequency $f_0$ can be set to a given value by adjusting the length (or cross-section area) of the acoustic tube 46 and the capacity of the speaker cabinet 41.

[Equation 1]

$$f_0 = \frac{1}{2\pi}\sqrt{\frac{1}{MC}} \quad \text{(Equation 1)}$$

With reference to the sound pressure frequency characteristics in FIG. 6 and the equivalent circuit in FIG. 7, the operations of a speaker system configured as above will be described. When an electrical input is applied to the speaker unit 44 attached to the front board 42 of the speaker cabinet 41, a diaphragm vibrates to emit sound. At the time, the sound emitted into the internal space of the speaker cabinet 41 is transmitted to the drone cone 45 attached to the front board 42 of the speaker cabinet 41. In addition, the sound from the rear of the speaker unit 44 is also transmitted to the acoustic tube 46 which is formed of the partition boards 47*a* and 47*b*. Here, since the end part 49 of the acoustic tube 46 is closed, the sound is not emitted from the acoustic tube 46 into the outside of the speaker cabinet.

The major difference between a conventional drone cone speaker system and a speaker system in accordance with the third embodiment is that the acoustic tube 46 is provided inside the speaker cabinet 41. Therefore, the operations of the speaker system in accordance with the third embodiment will be described in comparison with a conventional drone cone speaker system.

Here, in the third embodiment illustrated in FIGS. 5A and 5B, the measurements of the inside of the speaker cabinet 41 are 360 mm long, 210 mm wide and 8 mm thick. The speaker unit 44 is 90 mm long and 50 mm wide. Furthermore, the drone cone 45 has almost the same external size as the speaker unit 44.

Figure 6:
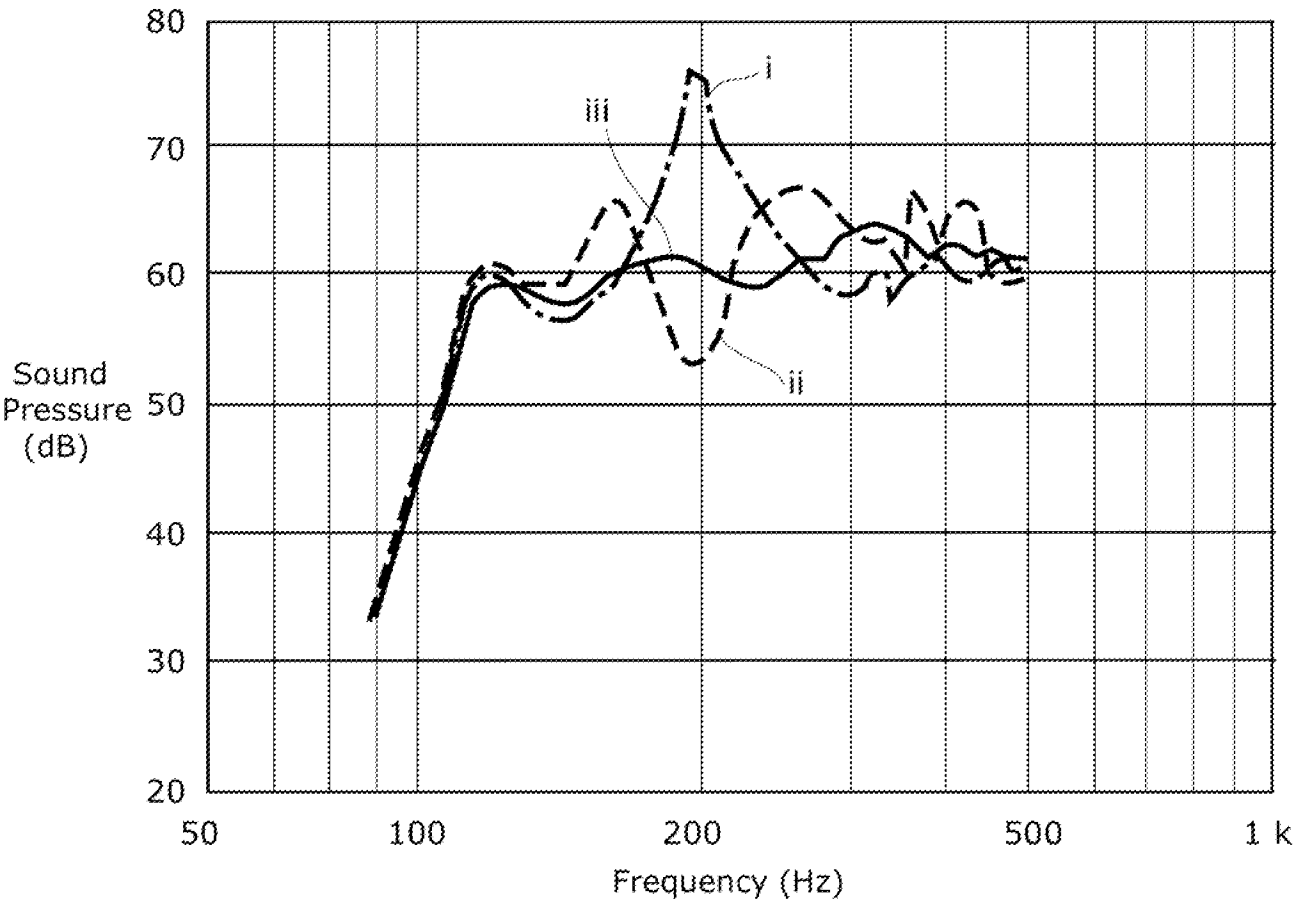
FIG. 6 shows sound pressure frequency characteristics of a speaker system in accordance with the third embodiment.

The characteristic i in FIG. 6 shows a sound pressure frequency characteristic of the speaker system which does not include the acoustic tube 46 in the speaker system illustrated in FIGS. 5A and 5B, i.e., a conventional drone cone speaker system.

The bass reproduction limit of the characteristic i in FIG. 6 is extended up to around a resonance frequency $f_{pp}$ of 120 Hz between the mass of the drone cone 45 and an acoustic compliance of the internal space of the speaker cabinet 41 due to a resonance of the drone cone 45. On the other hand, the peak of sound pressure at 200 Hz is caused by a resonance of the speaker unit 44 attached to the speaker cabinet 41. The speaker unit 44 has a high Q value of resonance due to a resonance of the diaphragm. Thus, the peak of sound pressure at 200 Hz is approximately 15 dB higher than the sound pressure level in the band around 200 Hz. If this remains the same, sound quality of the speaker system is significantly degraded.

Next, the operations of the speaker system when the acoustic tube 46 in accordance with the third embodiment is provided within the speaker cabinet 41 will be described. Here, the length L of the partition boards 47*a* or 47*b* is 150 mm and the width W of the sound path is 50 mm. The acoustic tube 46 is turned around by the partition boards 47*a* and 47*b*. When sound is considered to pass through the edge of the partition board 47*a* in an arc as shown in a broken line in FIG. 5A, the length of the sound path is approximately 410 mm. Therefore, a capacity Vb of the speaker cabinet 41 excluding a capacity Vh of 0.15 liters of the acoustic tube 46 is 0.45 liters.

Figure 7:
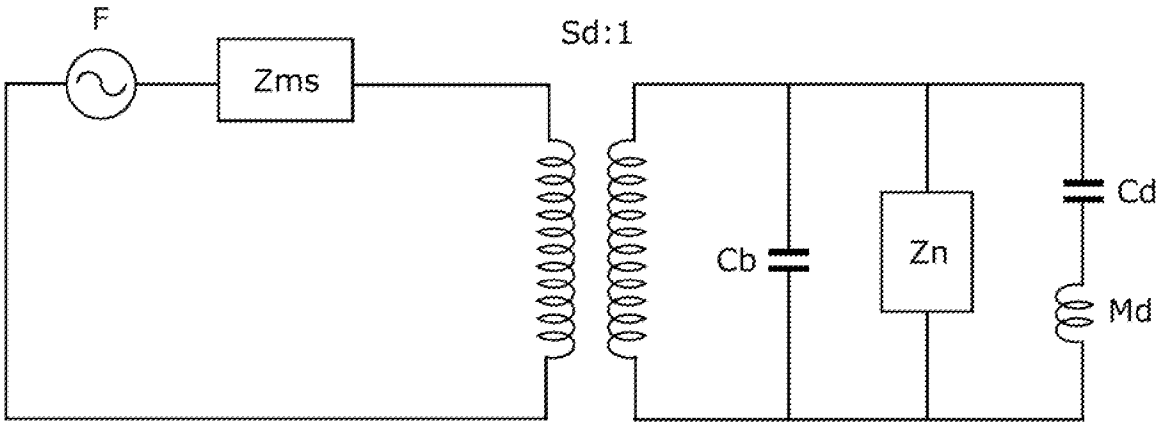
FIG. 7 is an equivalent circuit diagram of a speaker system in accordance with the third embodiment.

FIG. 7 shows an equivalent circuit of the speaker system in accordance with the third embodiment. In FIG. 7, F denotes a driving force. Zms denotes a machine impedance of the speaker unit 44. Sd denotes an area of the diaphragm. Cb denotes an acoustic compliance of the capacity Vb of the speaker cabinet 41. Zh denotes acoustic impedance when the acoustic tube 46 is viewed from the opening 48. Cd denotes an acoustic stiffness of the drone cone. Md denotes an acoustic mass of the drone cone.

When viewed from the diaphragm of the speaker unit (piezoelectric speaker) 44, the acoustic compliance Cb of the speaker cabinet 41 and an inductance component of the acoustic impedance of the acoustic tube 46 cause a resonance at around the resonance frequency $f_{pp}$. As is evident from the equivalent circuit in FIG. 7, this resonance is a parallel resonance. Therefore, when viewed from the diaphragm side of the speaker unit 44, the acoustic impedance of the resonance is very high, thus significantly dampening the vibrations of the diaphragm of the speaker unit (piezoelectric speaker) 44.

The characteristic ii in FIG. 6 is a sound pressure frequency characteristic when the acoustic tube 46 is formed of the partition boards 47*a* and 47*b* in the speaker cabinet 41. The resonance between the acoustic compliance Cb of the speaker cabinet 41 and an inductance component of the acoustic impedance of the acoustic tube 46 significantly suppresses the peak of the sound pressure in the sound pressure frequency characteristic at around a frequency $f_{pp}$ of 200 Hz, when compared to the characteristic in the absence of the acoustic tube 46, and causes a trough of around 6 dB.

Next, the characteristic iii in FIG. 6 shows a sound pressure frequency characteristic when the absorbing material 40 is provided near the end part 49 of the acoustic tube 46. The absorbing material 40 relaxes the Q value of the resonance between the acoustic compliance Cb of the speaker cabinet 41 and the inductance component of the acoustic impedance of the acoustic 46, leading to almost a flat sound pressure frequency characteristic at around 200 Hz, compared to when only the acoustic tube 46 is provided.

On the other hand, the acoustic tube 46 does not function as an acoustic tube in the bass range at the resonance frequency $f_{pp}$ of around 120 Hz between the mass of the drone cone 45 and the acoustic compliance of the speaker cabinet 41. Therefore, the capacity Vh of 0.15 liters and the capacity Vb of 0.45 liters of the speaker cabinet 41 are added to make a total capacity of Vh and Vb. In other words, the capacity of the acoustic tube 46 is included in a capacity of a conventional drone cone speaker cabinet. Thus, the sense of bass sound is rarely in shortage in contrast to the Patent Literature 2 in which the acoustic resistance member 72 provided at the rear of the speaker unit 73 lowers the sound pressure level to around the frequency $f_{op}$, which is the bass reproduction limit.

Here, the location of the absorbing material 40 in the acoustic tube 46 will be described. The case when the absorbing material 40 is provided at the end part 49 of the acoustic tube 46 as described in third embodiment will be compared with the case when the absorbing material 40 is provided at the opening 48 as disclosed in Patent Literature 2.

Figure 8:
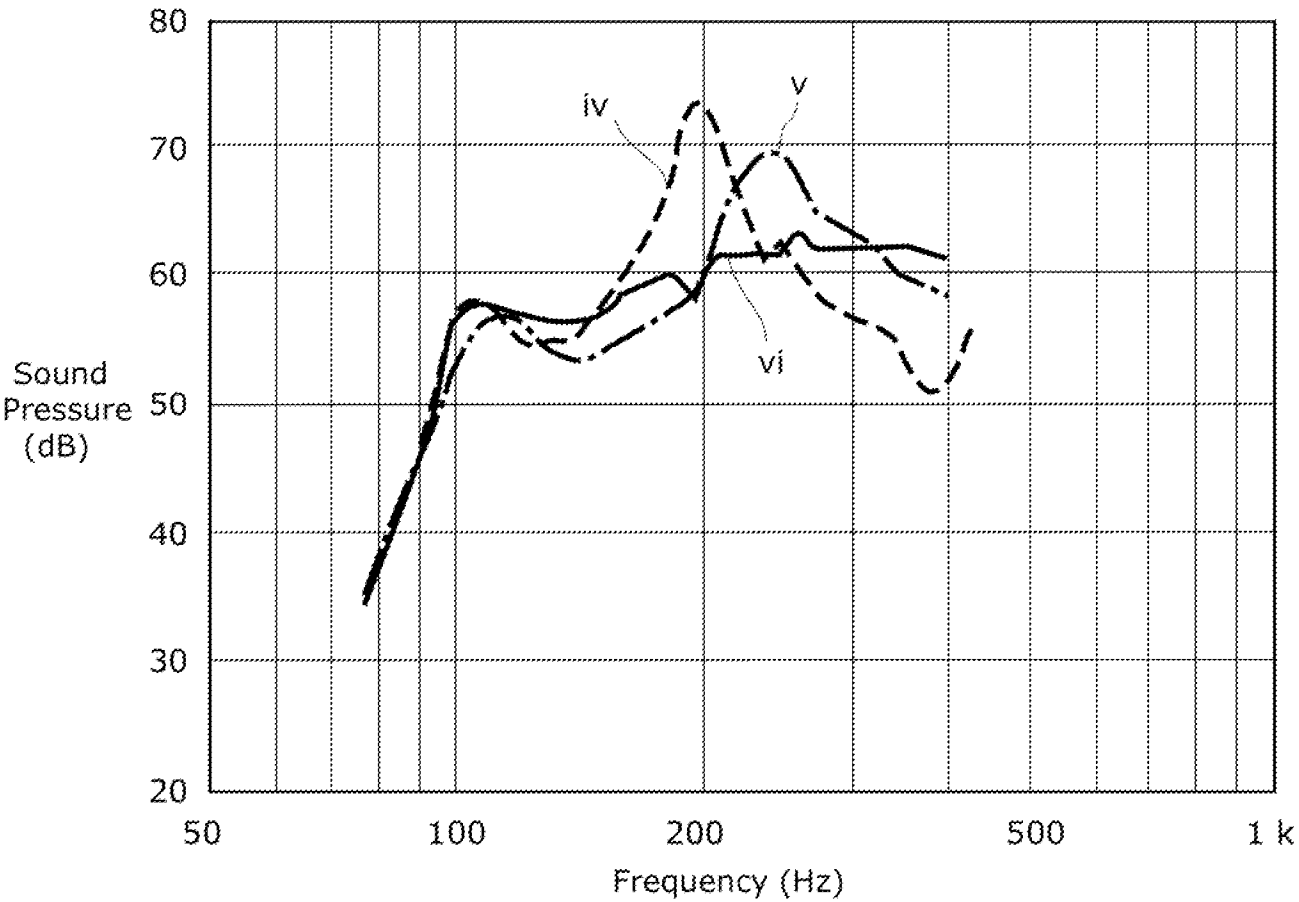
FIG. 8 shows sound pressure frequency characteristics when changing the location of an absorbing material in a speaker system in accordance with the third embodiment.

FIG. 8 shows the measurement result of sound pressure frequency characteristics of the speaker system, in almost the same configuration as the one shown in FIGS. 5A and 5B, (iv) when the acoustic tube 46 is not provided, (vi) when the absorbing material 40 is provided at the end part 49 of the acoustic tube 46 and (v) when the absorbing material 49 is provided at the opening 48 of the acoustic tube 46.

With reference to FIG. 8, in the characteristic iv in the absence of the acoustic tube 46, a high peak of sound pressure occurs at around 200 Hz due to the resonance of the speaker unit 44.

Next, in the characteristic v when the absorbing material 49 is provided at the opening 48 of the acoustic tube 46, the frequency at which the peak of sound pressure occurs increases to around 250 Hz. Therefore, sound pressure cannot be flattened. In contrast, in the characteristic vi when the absorbing material 40 is provided at the end part 49 of the acoustic tube 46, the peak of sound pressure at 200 Hz is suppressed and flat sound pressure frequency characteristic is achieved.

This result leads to a problem that the resonance frequency fluctuates when the absorbing material 40 is provided at the opening 48, rather than the effects that the acoustic impedance of the acoustic tube 46 changes and suppresses the Q value of the resonance. In addition, when the absorbing material 40 is provided at the opening 48 of the acoustic tube 46, damping effect of the absorbing material 40 also lowers sound pressure level in the bass range at around 100 Hz. In other words, it is clear that locating the absorbing material 40 at the end part 49 of the acoustic tube 46 is an effective means of suppressing the Q value of the resonance of the speaker system in accordance with the third embodiment, but of not affecting reproduction of the bass range.

Figure 9:
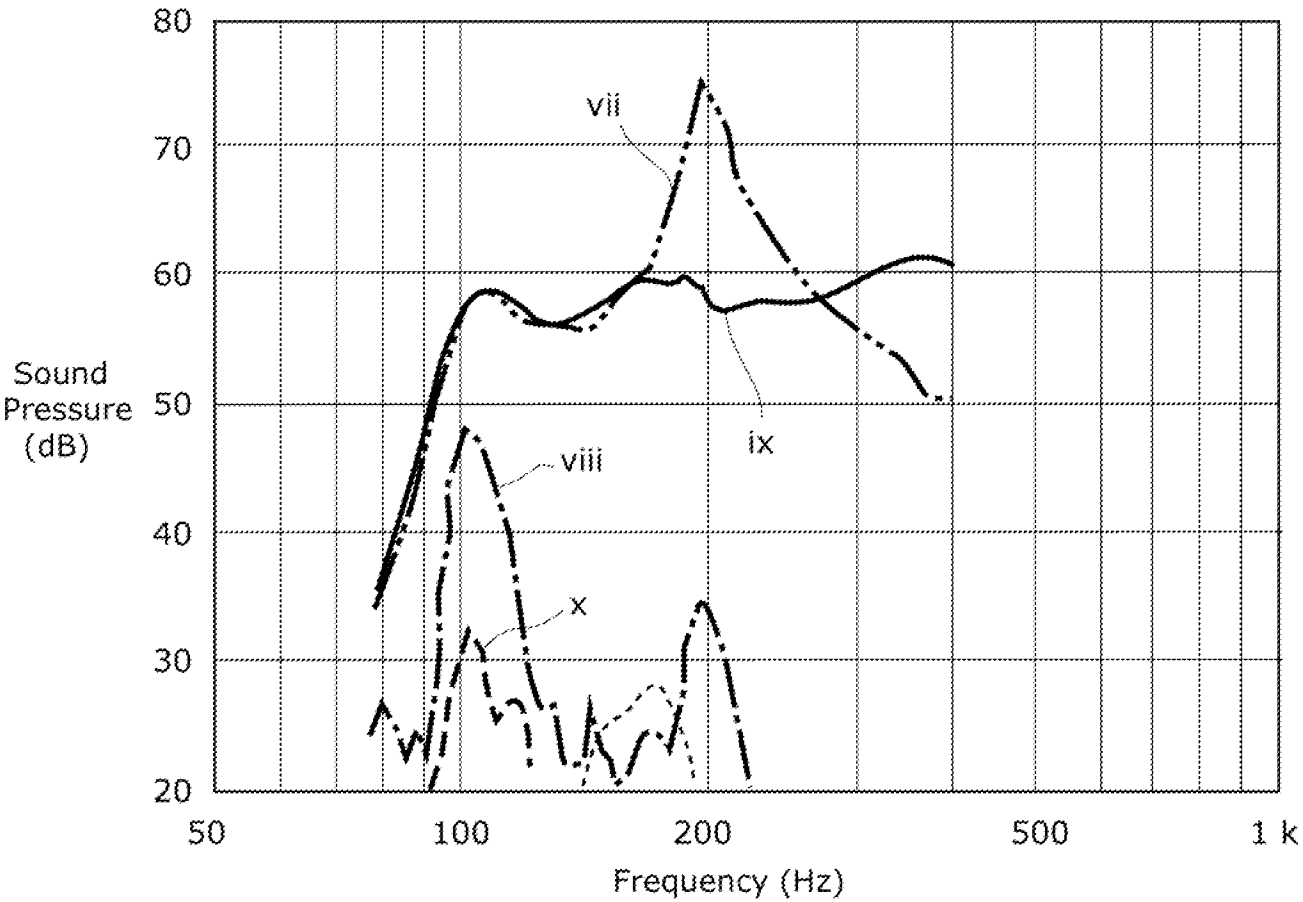
FIG. 9 shows sound pressure distortion frequency characteristics of a speaker system in accordance with the first embodiment.

In addition, the effect of decreasing harmonic distortion in accordance with the third embodiment will be described. FIG. 9 compares a sound pressure frequency characteristic and second harmonic distortion characteristic in sound pressure as to when the acoustic tube 46 is not provided in the speaker cabinet 41, and when the acoustic tube 46 is provided. In FIG. 9, the characteristic vii shows a sound pressure frequency characteristic when the acoustic tube 46 is not provided. The characteristic viii shows a second harmonic distortion when the acoustic tube 46 is not provided. The characteristic ix shows a sound pressure frequency characteristic when the acoustic tube 46 is provided. The characteristic x shows a second harmonic distortion when the acoustic tube 46 is provided. Note that as mentioned above, the acoustic tube 46 suppresses the peaks of sound pressure at around 200 Hz.

Here, as to distortion characteristics, the second harmonic distortion having a peak of 45 dB at around 100 Hz occurs as indicated by the characteristic viii in absence of the acoustic tube 46. However, by providing the acoustic tube 46, the second harmonic distortion at around 100 Hz decreases by around 20 dB as indicated by the characteristic x.

This is a secondary effect of suppressing the peak of sound pressure at 200 Hz by a resonance between the acoustic tube 46 and the capacity of the speaker cabinet 41. This is because the resonance between the acoustic tube 46 and the capacity of the speaker cabinet 41 dampens vibrations of sound pressure components at 200 Hz included in vibration components of the diaphragm at 100 Hz, i.e., vibrations of second harmonic components. This reduces the distortion at 100 Hz which is a bass reproduction limit and a speaker system with improved sound quality can be made.

Note that in the third embodiment, the acoustic tube 46 is formed by placing partition boards 47*a* and 47*b* between the front board 42 and back board 43 of the speaker cabinet 41. However, the third embodiment is not limited to this configuration. When the separate acoustic tube 46 of any opening shape such as a round shape is provided in the speaker cabinet 41, the same effects are obtained as the third embodiment.

Fourth Embodiment

Figure 10:
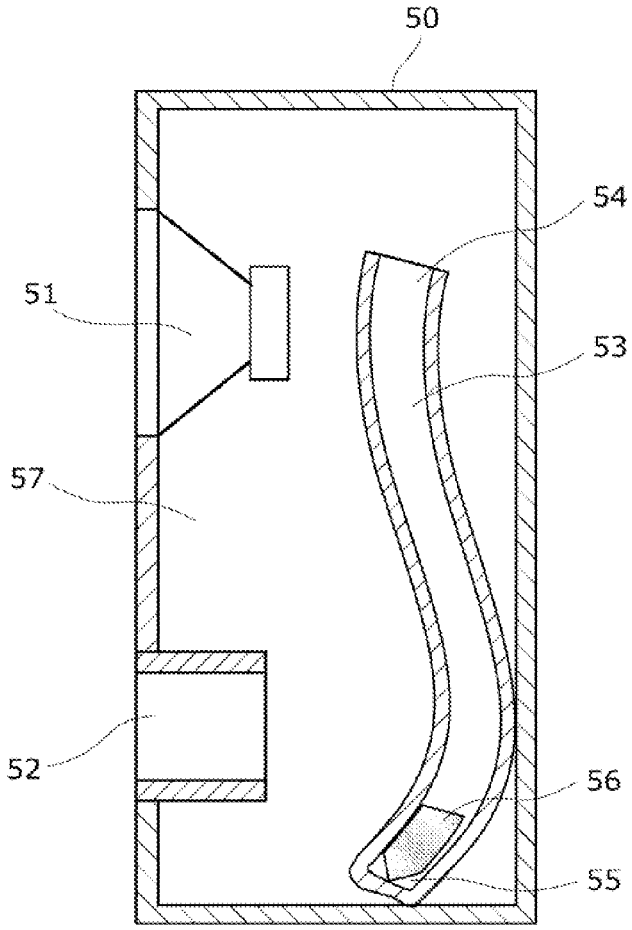
FIG. 10 is a cross-sectional view of a speaker system in accordance with the fourth embodiment.

Next, FIG. 10 shows a cross-sectional view of a speaker system in accordance with the fourth embodiment. The speaker system illustrated in FIG. 10 includes a speaker cabinet 50, an electrodynamic speaker unit 51, a bass reflex port 52, an acoustic tube 53, and a sound absorbing material 56. The acoustic tube 53 with one end (opening 54) open and the other end (end part 55) closed has the absorbing material 56 at the end part 55.

The operations of a speaker system configured as above will be described. The differences from the third embodiment are that the piezoelectric speaker unit 44 is replaced by the electrodynamic speaker unit 51, and that the drone cone 45 is replaced by the bass reflex port 52.

The change from the drone cone 45 to the bass reflex port 52 does not dramatically change the operations of the speaker system. A resonance is caused by an acoustic compliance of an internal space 57 of the speaker cabinet 50 and the acoustic mass of the bass reflex port 52, and a bass reproduction range is extended. This is a basic function of a bass reflex speaker system as same as the third embodiment.

On the other hand, unlike the piezoelectric speaker unit 44, the Q value of the lowest resonance frequency is suppressed by electromagnetic damping resistance in the electrodynamic speaker unit 51. However, the electromagnetic damping resistance is inversely proportional to the square of the product of a length of a voice coil L and a magnetic flux density B, $(BL)^2$. Therefore, when a magnet of a magnetic circuit constituting the electrodynamic speaker unit 51 becomes smaller, the magnetic flux density B also becomes smaller. Thus, damping of the Q value is no longer effective.

Figure 11:
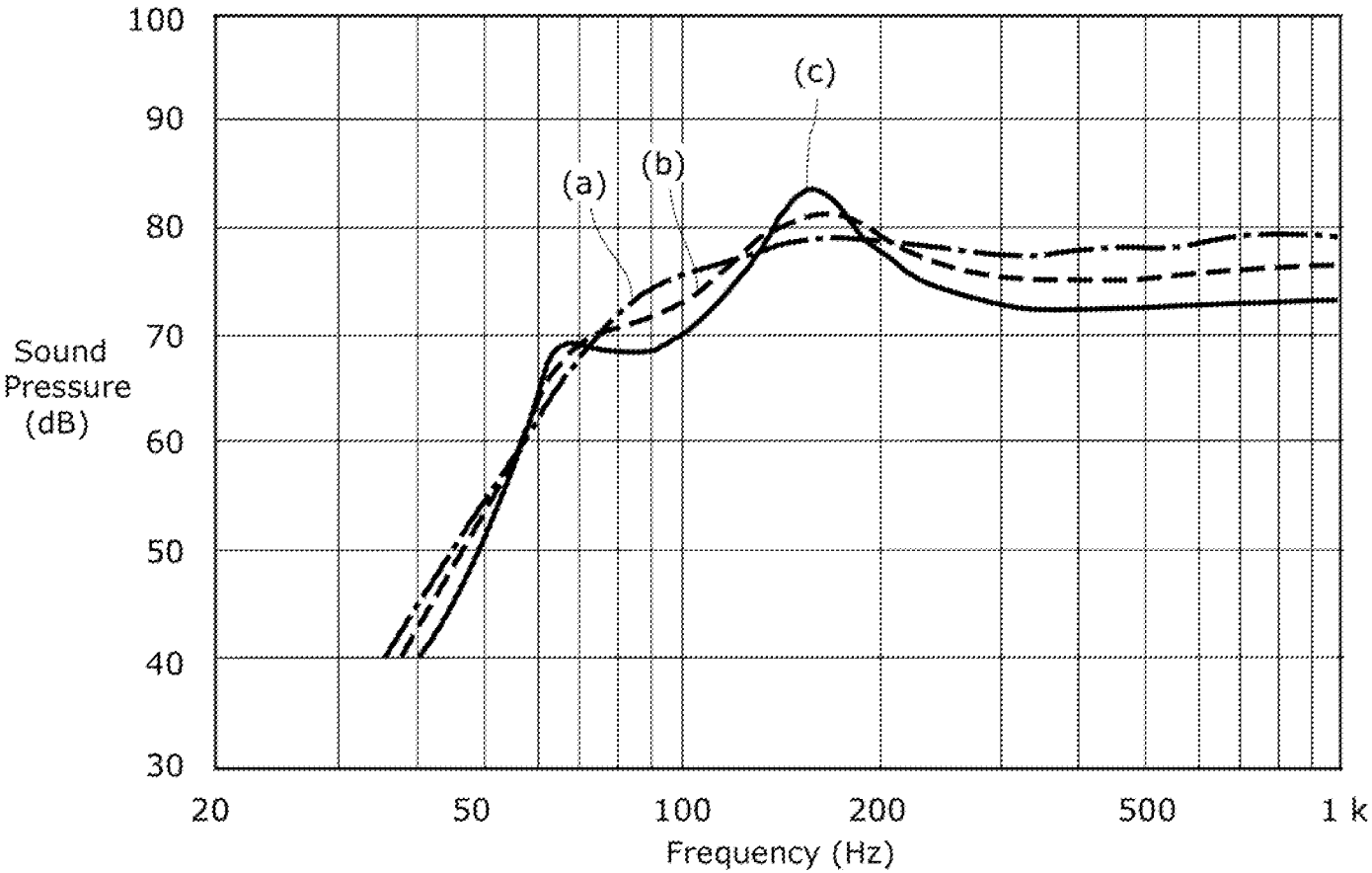
FIG. 11 shows sound pressure frequency characteristics of a conventional bass reflex speaker system.

FIG. 11 shows sound pressure frequency characteristics of a bass reflex speaker system that includes the 8-cm-aperture electrodynamic speaker unit 51 which is attached to the speaker cabinet 50 having an internal capacity of 1 liter. The characteristics are calculated by changing the value of BL. Here, as constants for the 8-cm-aperture speaker, the vibration mass is 4.5 g, a voice coil impedance is 8Ω, an effective radius of the diaphragm is 30 mm.

In FIG. 11, BL=6 in the characteristic (a), BL=4 in the characteristic (b), and BL=2 in the characteristic (c). When BL=6, the electromagnetic damping resistance is large. Therefore, the sound pressure frequency characteristic at around 200 Hz which corresponds to the resonance frequency $f_{OB}$ of the speaker unit 51 attached to the speaker cabinet 50 is almost flat. On the other hand, when BL=2, there is a shortage of damping of the Q value of the resonance and a sound pressure peak of around 10 dB occurs at around 200 Hz. Even though such a speaker is in shortage of damping of the Q value due to small BL, when the acoustic tube 53 is provided within the speaker cabinet 50 as described in the fourth embodiment illustrated in FIG. 10, the same effects as the third embodiment can be obtained. In other words, vibrations of the diaphragm of the electrodynamic speaker unit 51 can be suppressed by a resonance between an acoustic compliance of the capacity Vb of the internal space 57 of the speaker cabinet 50 which excludes the capacity Vh of the acoustic tube 53 and an inductance component of an acoustic impedance of the acoustic tube 53. In addition, the absorbing material 56 which is provided at the end part 55 of the acoustic tube 53 can achieve flat sound pressure frequency characteristics.

Here, the relationship between the capacity Vh of the acoustic tube 53 and the capacity Vb of the internal space 57 of the speaker cabinet 50 which excludes the capacity Vh of the acoustic tube 53 will be described. The peaks of sound pressure at around 200 Hz can be suppressed by a resonance between an acoustic compliance of the capacity Vb of the internal space 57 of the speaker cabinet 50 and an inductance component of an acoustic impedance of the acoustic tube 53. The tube diameter and the tube length of the acoustic tube 53 can be set to any value.

Figure 12:
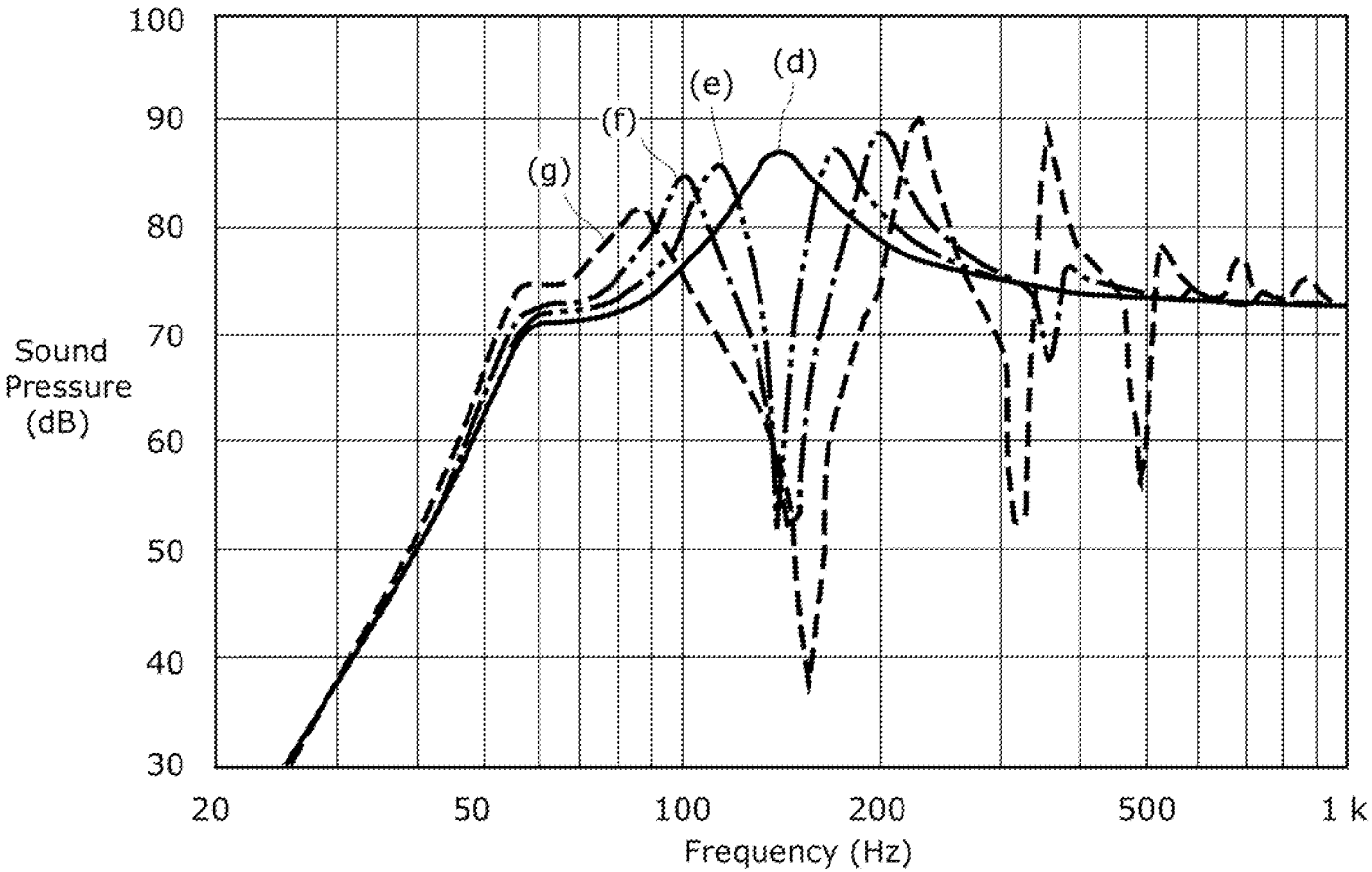
FIG. 12 shows sound pressure frequency characteristics when changing the capacity ratio of an acoustic tube of a speaker system in accordance with the fourth embodiment.

The longer the tube diameter and tube length of the acoustic tube 53, the larger the capacity Vh of the acoustic tube 53. This means the smaller capacity Vb of the internal space 57 of the speaker cabinet 50 which excludes the capacity Vh of the acoustic tube 53. FIG. 12 shows sound pressure frequency characteristics when changing the ratio Vh/Vb of the two capacities described above from 0.2 to 0.5 to 0.8. In FIG. 12, in order to clarify the effects of the acoustic tube 53, the absorbing material 56 is not provided at the end part 55 of the acoustic tube 53.

In FIG. 12 shows sound pressure frequency characteristics. A characteristic (d) shows when the acoustic tube 53 is not provided. A characteristic (e) shows when Vh/Vb=0.2. A characteristic (f) shows when Vh/Vb=0.5. A characteristic (g) shows when Vh/Vb=0.8 The larger the ratio Vh/Vb, i.e., the larger the ratio of the capacity of the acoustic tube 53 to that of the speaker cabinet 50 by increasing the tube diameter or tube length of the acoustic tube 53, the larger the frequency band width of the trough of sound pressure. Therefore, the ratio Vh/Vb may be determined in accordance with a frequency band width of a sound pressure peak of the electrodynamic speaker unit 51. For instance, it is preferable that the larger the band width of the sound pressure peak of the speaker unit 51, the larger the ratio of the internal space capacity of the acoustic tube 53 to that of the speaker cabinet 50.

The embodiments described above can independently be implemented or may optionally be combined.

Although the embodiments of the present invention have been described with reference to the drawings, the present invention is not limited to the above-illustrated embodiments. Various kinds of modifications and variations may be added to the illustrated embodiments within the same or equal scope of the present invention.

INDUSTRIAL APPLICABILITY

The present invention can be used in a wide variety of applications especially as a speaker system for television sets and mobile computers which have become thinner or as a speaker system for cars and others.

REFERENCE SIGNS LIST

1, 20, 41, 50, 60, 70 speaker cabinet
2, 21, 42 front board
3, 22, 43 back board
4, 5, 6, 7, 23, 24, 25, 26, 62*a*, 62*b*, 62*c*, 62*d* side board
8*a*, 8*b*, 27*a*, 27*b*, 27*c*, 29, 47*a*, 47*b* partition board
9, 31, 44, 51, 63, 71 speaker unit
10, 32 back capacity
11, 28, 46, 53 acoustic tube
12, 48, 54 opening
13, 49, 55 end part
30 acoustic port
45 drone cone
61*a* top board
61*b* bottom board
64*a*, 64*b* first acoustic tube
40, 56, 65*a*, 65*b*, 67*b*, 100 absorbing material
66*a*, 66*b* second acoustic tube
72 acoustic resistance member

73 volume
74 capacity
52, 75 bass reflex port

The invention claimed is:

1. A speaker system comprising:

a speaker cabinet;

a speaker unit installed in a wall surface of said speaker cabinet and configured to output sound; and an acoustic tube having ends, one of which is open and the other of which is closed, wherein a resonance frequency that is determined by an inductance component of an acoustic impedance of said acoustic tube and an acoustic compliance of said speaker cabinet is approximately identical to a peak frequency of a sound pressure of said speaker unit which is installed in said speaker cabinet.

2. A speaker system according to claim 1, wherein said acoustic tube is provided inside said speaker cabinet such that a side wall surface of said acoustic tube crosses a direction in which standing waves propagate, the waves occurring inside said speaker cabinet.

3. The speaker system according to claim 2, wherein said speaker cabinet is a pillar-shaped speaker cabinet that is greater in height than in width or depth, and said acoustic tube is provided inside said speaker cabinet so as to reduce an apparent height of an inside of said speaker cabinet.

4. The speaker system according to claim 2, wherein said speaker cabinet is a thin cuboid that is smaller in thickness than in length or breadth, and said acoustic tube is provided inside said speaker cabinet so as to reduce an apparent length in a longer direction of an inside of said speaker cabinet.

5. The speaker system according to claim 2, wherein said speaker cabinet has a bass reflex port.

6. The speaker system according to claim 1, wherein the speaker system is a bass reflex speaker system, and the resonance frequency is approximately identical to the peak frequency which is higher than a lowest resonance frequency of said speaker unit if not installed in said speaker cabinet.

7. The speaker system according to claim 1, wherein the larger a band width of a sound pressure peak of said speaker unit, the larger a ratio of an internal space capacity of said acoustic tube to an internal space capacity of said speaker cabinet.

8. The speaker system according to claim 1, wherein said acoustic tube is formed of an inner wall surface of said speaker cabinet and partition boards that are connected to the inner wall surface.

9. The speaker system according to claim 1, wherein a sound absorbing material is provided at the closed end of said acoustic tube.

* * * * *